US006918506B2

(12) United States Patent
Ramirez et al.

(10) Patent No.: US 6,918,506 B2
(45) Date of Patent: Jul. 19, 2005

(54) PACKAGING CONTAINER

(75) Inventors: Richard L. Ramirez, Lawrenceville, GA (US); Mark A. Bergeron, Lithonia, GA (US)

(73) Assignee: Tekni-Plex, Inc., Somerville, NJ (US)

( * ) Notice: Subject to any disclaimer, the term of this patent is extended or adjusted under 35 U.S.C. 154(b) by 0 days.

(21) Appl. No.: 10/228,562

(22) Filed: Aug. 27, 2002

(65) Prior Publication Data

US 2004/0040973 A1 Mar. 4, 2004

(51) Int. Cl.[7] ..... B65D 21/32
(52) U.S. Cl. ..... 220/675
(58) Field of Search ..... 220/669, 670, 220/671, 673, 657, 658, 656, 640, 642, 643, 675, 659; 206/515, 518, 516

(56) References Cited

U.S. PATENT DOCUMENTS 3,185,371 A * 5/1965 Reifers ..... 229/406
3,659,741 A * 5/1972 Corelli ..... 220/592.01
4,113,095 A * 9/1978 Dietz et al. ..... 206/508
4,834,243 A * 5/1989 Langenbeck ..... 206/557
5,033,639 A * 7/1991 Przytulla ..... 220/604
5,934,472 A * 8/1999 Ramirez et al. ..... 206/557

* cited by examiner

*Primary Examiner*—Stephen Castellano
(74) *Attorney, Agent, or Firm*—Pitney Hardin LLP

(57) ABSTRACT

A packaging container is integrally formed from plastic foam material, such as extruded polystyrene foam. The packaging container has a base, four sidewalls extending from the base, and four corners, each extending between a pair of adjacent sidewalls. The sidewalls have substantially rectangular protrusions extending from the base to a top edge to strengthen the sidewalls against lateral forces. The sidewalls may also have rounded ribs which protrude into the interior of the packaging container for further reinforcement.

25 Claims, 8 Drawing Sheets

PACKAGING CONTAINER

BACKGROUND OF THE INVENTION

1. Field of the Invention

The present invention relates to plastic foam packaging. More specifically, it relates to the generally bin-shaped containers in which small fruits and vegetables, such as berries, cherry tomatoes and mushrooms, are presented for retail sale at supermarkets and other retail food outlets.

2. Description of the Prior Art

Packaging containers of the subject type are well-known in the art. Traditionally, such containers were molded from wood pulp or recycled paper. More recently, they have been integrally molded from sheets of extruded plastic foam material, such as extruded polystyrene, in a wide variety of sizes. Packaging containers of this type are shown in U.S. Pat. No. 5,265,756 to Meier et al. and U.S. Pat. No. Des. 296,192 to Ramirez, the teachings of which are incorporated herein by reference.

The sizes of the individual containers are, of course, chosen to meet consumer preferences for the amount, be it measured by weight or volume, of the product to be sold therein. The sizes, or, more accurately, the dimensions, of the container must also satisfy the requirements of the machinery used to fill and wrap them individually, of the so-called master containers in which a plurality of individual containers are packed for shipment to retail outlets, and of the retail outlets themselves, where the individual containers must be conveniently disposable on designated shelf space.

The present invention was motivated by changes made recently in the mushroom industry, but this should not be construed to limit the present invention to use in that industry alone. There, however, the individual containers, commonly referred to as mushroom tills, have customarily been sized so that a given number of them would fit into a master container used in the industry. Specifically, the inside dimensions, by length and width, of the master container used until recently were such that it could hold twelve 8-oz. tills in a 3×4 array; ten 12-oz. tills in a 2×5 array; eight 16-oz. tills in a 2×4 array; four 24-oz. tills in a 2×2 array; or four 40-oz. tills in a 2×2 array, the 24-oz. tills having the same length and width as the 40-oz. tills, but a smaller depth. The sizes, expressed in ounces, of the tills refer to the amount of mushrooms, by weight, they are designed to hold.

Recently, the inside dimensions of the master container used by at least one mushroom grower were reduced, making it impossible to pack the tills in the arrays described above without changing their dimensions as well.

It will be immediately apparent to the reader that, in order to fit the tills into the smaller master container in the arrays set forth above, the area, or "footprint", occupied by each individual till had to be reduced. However, in order for the tills to continue to hold the same amount, in ounces, of mushrooms, each would necessarily have to be made deeper than those previously used.

Accordingly, the packaging containers, or mushroom tills, of the present invention have sidewalls which are higher and steeper than those of the packaging containers of the prior art. Moreover, because they are higher and steeper, the sidewalls have features designed to strengthen them and to enhance the structural integrity of the containers as a whole.

SUMMARY OF THE INVENTION

The present invention, then, is a packaging container for packaging goods, such as small fruits, vegetables and mushrooms. When used to package mushrooms, the container may be referred to as a mushroom till.

The packaging container is integrally formed from a plastic foam material, such as extruded polystyrene foam. The packaging container has a base with a top surface and a bottom surface. The top surface is literally the bottom of the interior of the container, while the bottom surface is the underside of the exterior of the container. The bottom surface defines a bottom plane which coextends with a planar surface on which the container may be placed. The bottom surface may additionally be slightly concave to provide it with additional strength against interior loading and to accommodate plastic film which may be used to wrap the container when its has been filled.

The packaging container also has a plurality of sidewalls integrally formed with and extending from the base. Each sidewall has an inner surface, an outer surface and a top edge extending therebetween. The inner surface of the sidewalls is oriented at a first angle relative to a reference direction perpendicular to the bottom plane.

Each sidewall further has a substantially rectangular indentation in its outer surface. The indentation extends as a substantially rectangular protrusion on the inner surface of the sidewall. The protrusion has a surface oriented at a second angle relative to a reference direction perpendicular to the bottom plane. The second angle may be equal to or greater than the first angle.

The packaging container further has a plurality of corners. Each corner is integrally formed with and extends between a pair of sidewalls, and is integrally formed with and extends from the base.

The packaging container, as will be discussed in detail below, has two principal embodiments. In the first, the sidewalls extend from the base, their inner surfaces being oriented at a first angle relative to a reference direction perpendicular to the bottom plane. Substantially halfway between the top surface of the base and the top edge of the sidewall, the sidewall flares outwardly, its inner surface then being oriented at a third angle relative to a reference direction perpendicular to the bottom plane.

In this embodiment, a pair of mutually facing sidewalls, particularly the pair having the longer sidewalls of a rectangularly shaped packaging container, may additionally have a pair of rounded ribs, one on each side of the substantially rectangular protrusion on the inner surface. The rounded ribs may extend from the top surface of the base to a point substantially halfway between the top surface of the base and the top edge of the sidewall. The rounded ribs appear as rounded protrusions on the inner surface of the sidewall, and as rounded indentations on the outer surface, and have a surface oriented at a fourth angle relative to a reference direction perpendicular to the bottom plane.

In the second principal embodiment, the first angle, at which the inner surface of the sidewall is oriented relative to the reference direction perpendicular to the bottom plane, is the same as the second angle, at which the surface of the substantially rectangular protrusion is oriented relative to the same reference direction.

Both principal embodiments may additionally have a flange integrally formed with the top edge of the sidewalls and extending outwardly and downwardly therefrom. The flange has an upper surface with an inner portion and an outer portion, the outer portion being inclined downwardly toward the bottom plane at a fifth angle. The flange also has an edge surface and a lower surface, and, as a whole, permits plastic film used to wrap the packaging container after it has been filled to grab the top edge more effectively.

The outer surface of the sidewalls may also have a bead extending thereon around the packaging container below the flange to further strengthen the top edge thereof.

The present invention will now be described in more complete detail with frequent reference being made to the drawings identified below.

DETAILED DESCRIPTION OF THE PREFERRED EMBODIMENTS

Figure 1:
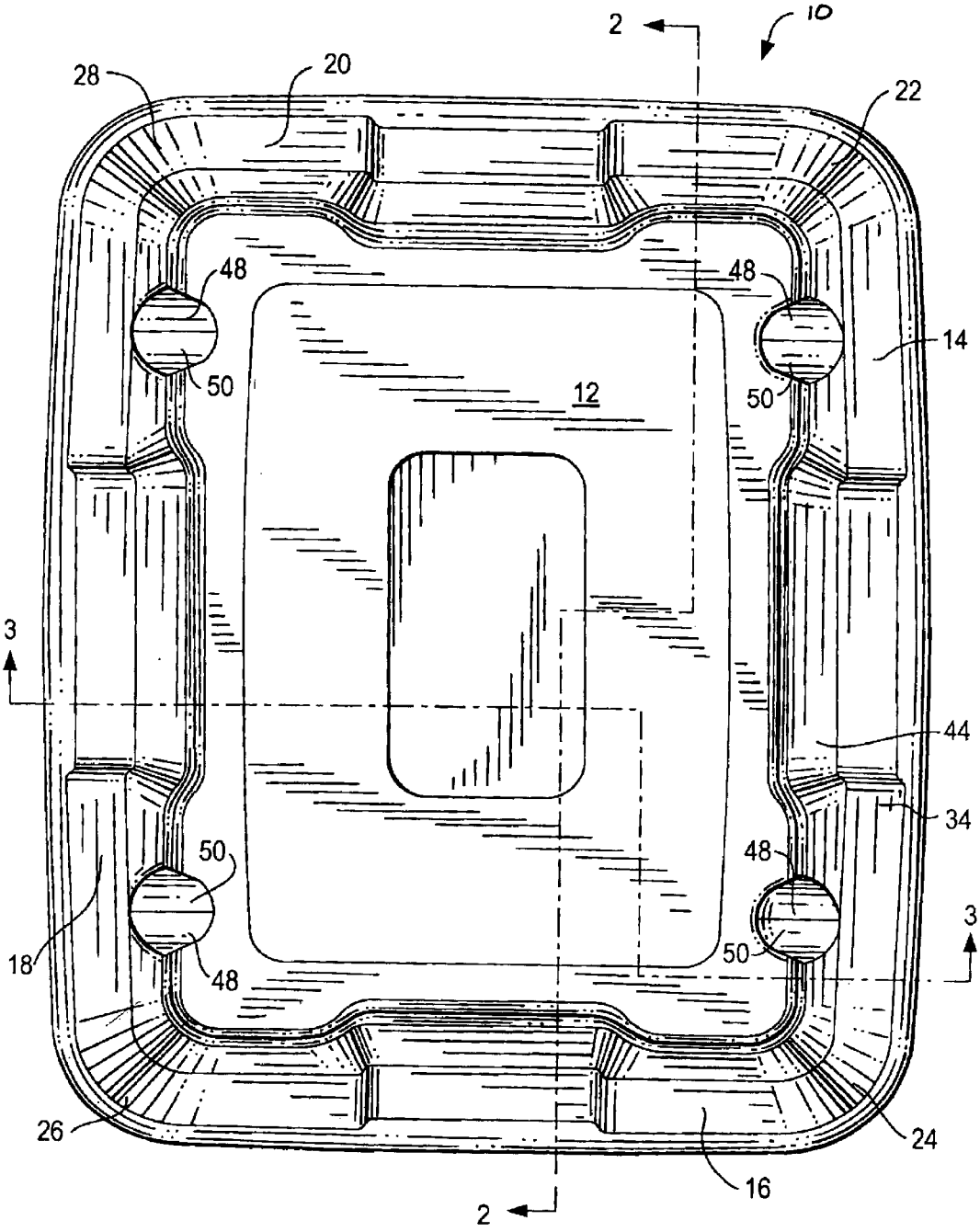
FIG. 1 is a top view of a first embodiment of the packaging container of the present invention.
Figure 2:
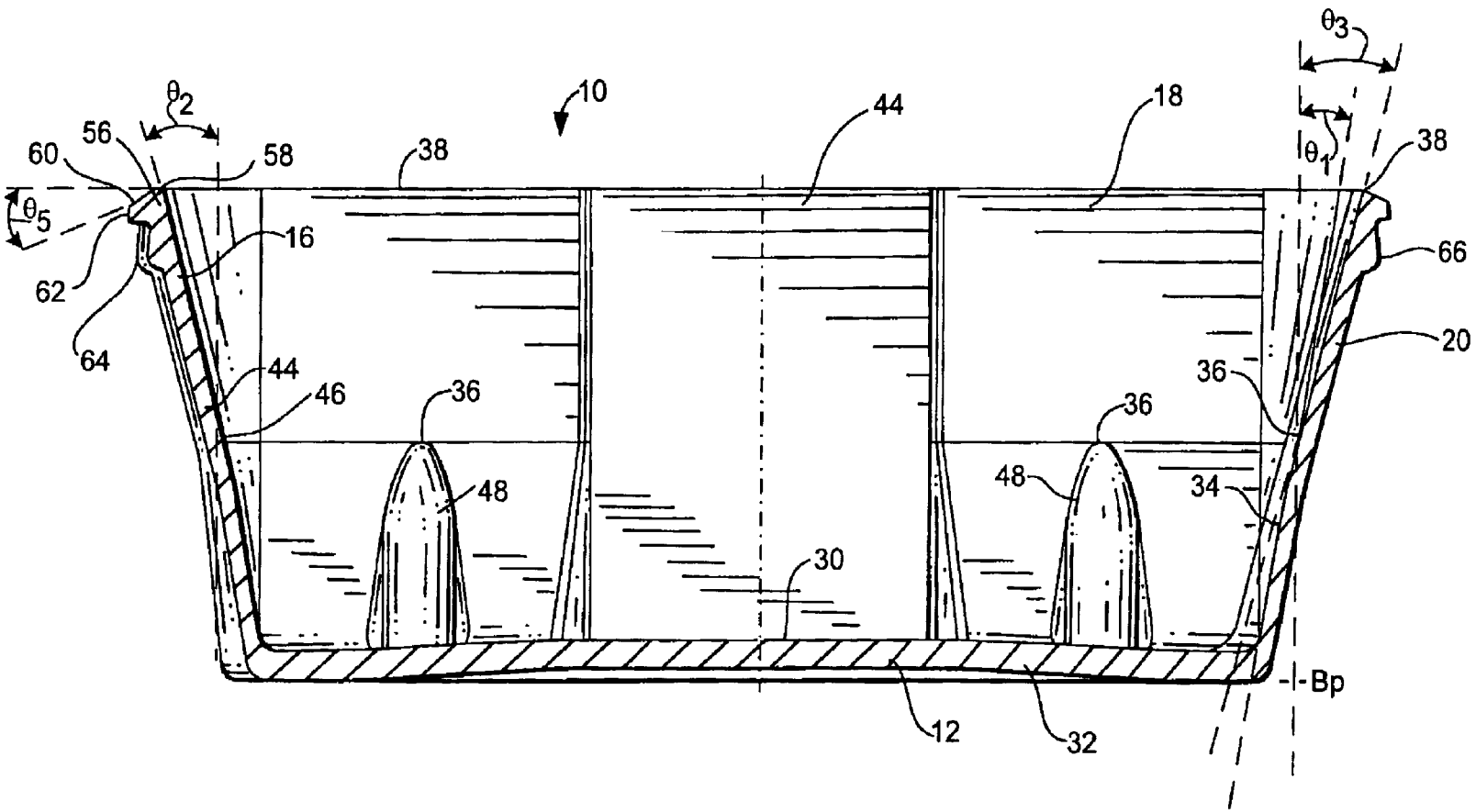
FIG. 2 is a cross-sectional view taken as indicated by line 2–2' in FIG. 1.
Figure 3:
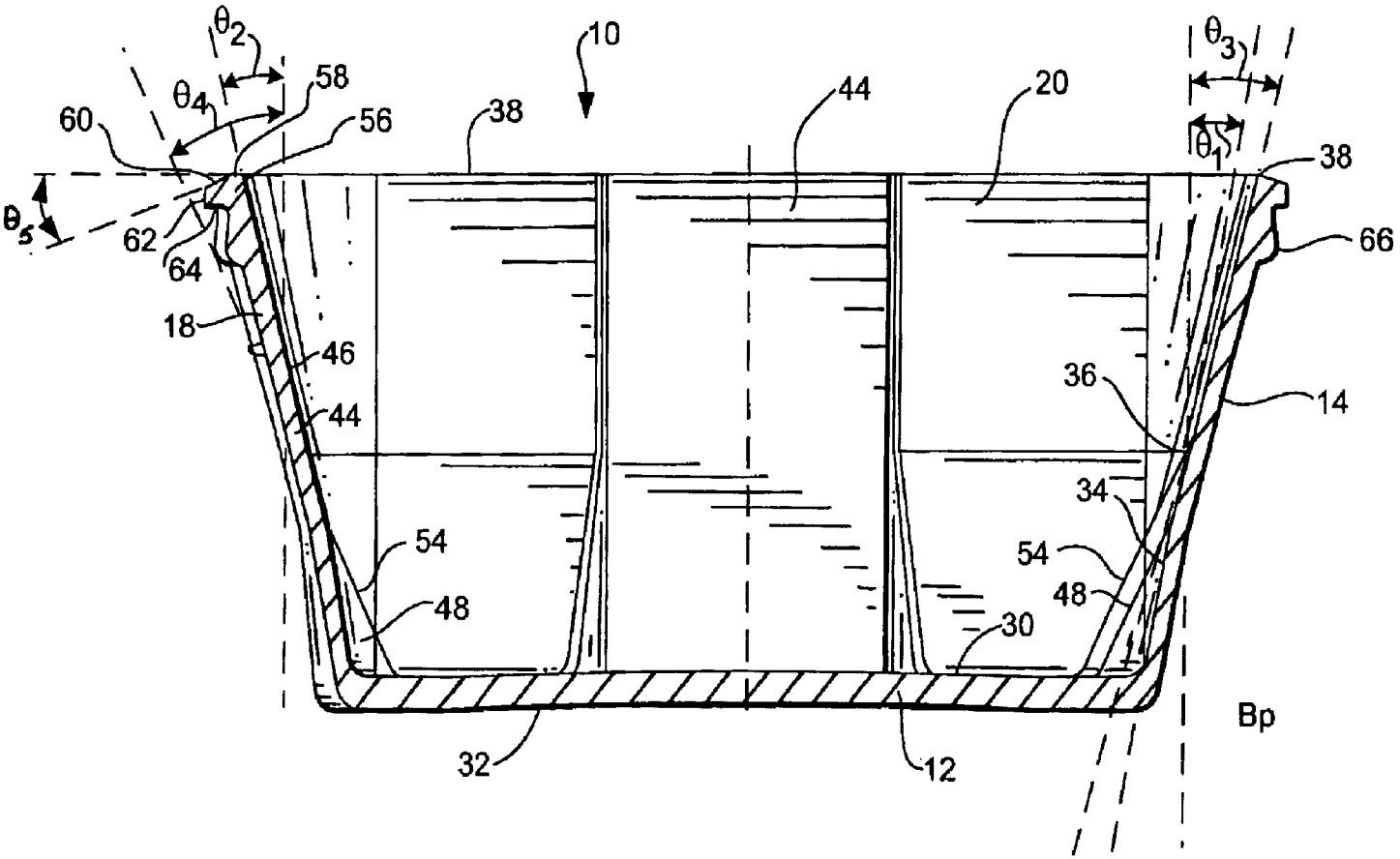
FIG. 3 is a cross-sectional view taken as indicated by line 3–3' in FIG. 1.
Figure 4:
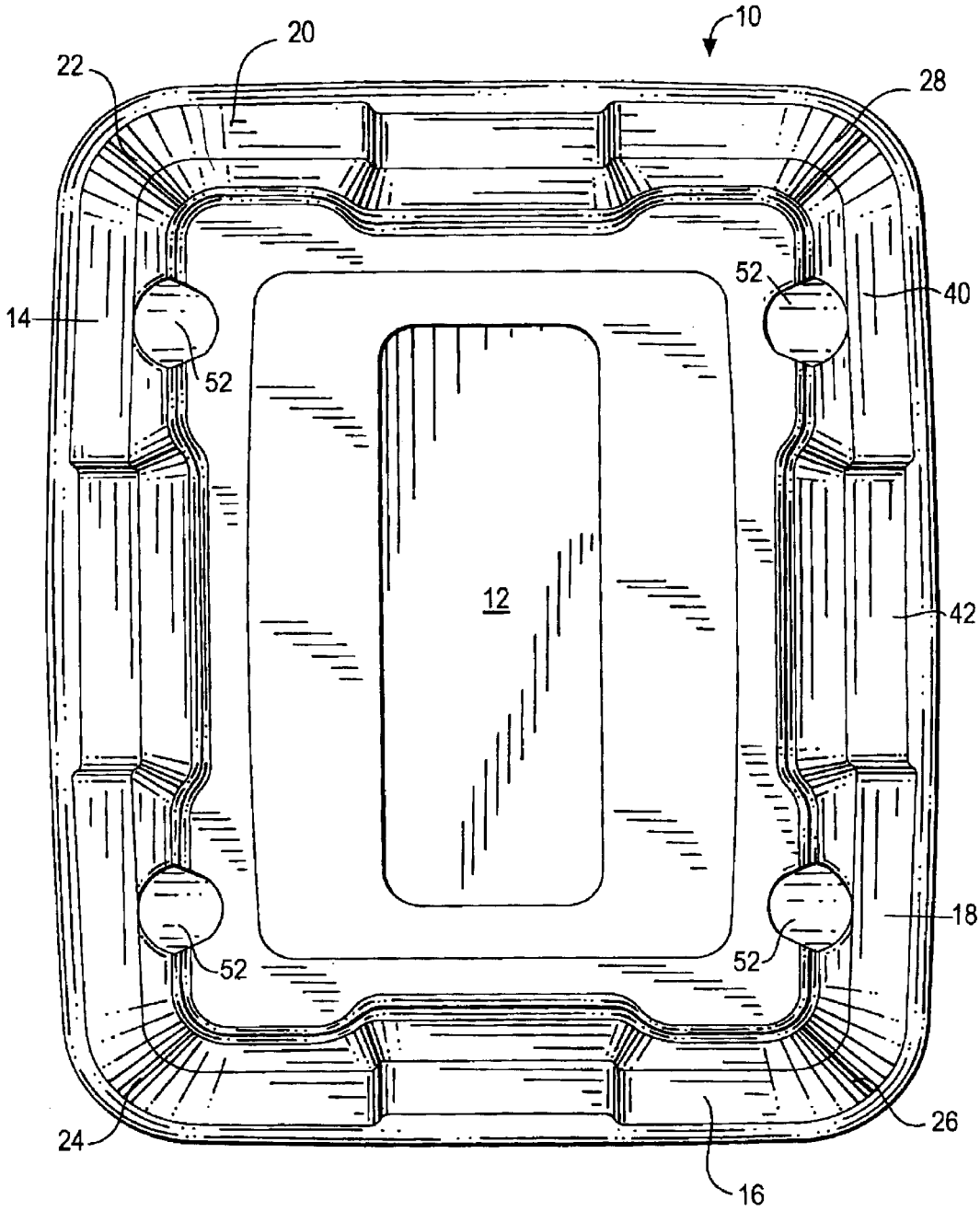
FIG. 4 is a bottom plan view of the first embodiment.

Turning now more particularly to these figures, FIGS. 1 through 4 show a first embodiment of the present packaging container. FIGS. 1 and 4 are top and bottom plan views, respectively. FIG. 2 is a cross-sectional view taken as indicated by line 2–2' in FIG. 1; FIG. 3 is a cross-sectional view taken as indicated by line 3–3' in FIG. 1.

Packaging container 10, as shown in these figures, includes a base 12, four sidewalls 14,16,18,20, and four corners 22,24,26,28 integrally formed from a plastic foam material, specifically, extruded polystyrene foam.

Base 12, as may be more readily seen in FIGS. 2 and 3, has a top surface 30 and a bottom surface 32. The top surface 30 is literally the bottom of the interior of the packaging container 10, while the bottom surface 32 is the underside of the exterior of the packaging container 10. The bottom surface 32 defines a bottom plane BP which coextends with a planar surface on which the packaging container 10 may be placed. As shown in FIGS. 2 and 3, the base 12, and particularly its bottom surface 32, may be concave, as indicated by its upward bulge relative to bottom plane BP, to strengthen it against interior loading and to accommodate plastic film which may be used to wrap the container when it has been filled in order to minimize rocking by the wrapped containers.

The sidewalls 14,16,18,20 each have an inner surface, an outer surface and a top edge extending therebetween. Referring particularly to FIGS. 2 and 3, and to the cross sections through sidewall 20 and sidewall 14 shown respectively therein, the sidewalls 14,16,18,20 have an inner surface 34 which is oriented at a first angle, $\theta_1$, relative to a reference direction perpendicular to the bottom plane BP. The first angle, $\theta_1$, may be, for example, 10°.

At a point 36 substantially halfway between the top surface 30 of the base 12 and the top edge 38 of sidewalls 14,16,18,20, the sidewalls 14,16,18,20 flare outwardly to orient their inner surfaces at a third angle, $\theta_3$, relative to a reference direction perpendicular to the bottom plane BP. The third angle, $\theta_3$, may be, for example, 15°.

Each of the four sidewalls 14,16,18,20 has a substantially rectangular indentation 42 on its outer surface 40, as shown most clearly in the bottom plan view of the packaging container 10 given in FIG. 4. The substantially rectangular indentations 42 extend as substantially rectangular protrusions 44 on the inner surface 34 of each sidewall 14,16,18,20. The protrusions 44 have a surface 46, as shown in FIGS. 2 and 3, which is oriented at a second angle, $\theta_2$, relative to a reference direction perpendicular to the bottom plane BP. The second angle may be 15°.

In this first embodiment, a pair of mutually facing sidewalls 14,18, which are the longer sidewalls of the rectangularly shaped packaging container 10, have a pair of rounded ribs 48, one on each side of the substantially rectangular protrusion 44 on the inner surface 34 of those two sidewalls 14,18. The rounded ribs 48 extend from the top surface 30 of the base 12 to the point 36 substantially halfway between the top surface 30 of the base 12 and the top edge 38 of the sidewalls 14,18. The rounded ribs 48 appear as rounded protrusions 50 on the inner surface 34 of sidewalls 14,18, and as rounded indentations 52 on the outer surface 40 thereof. The rounded ribs 48 have a surface 54 oriented at a fourth angle relative to a reference direction perpendicular to the bottom plane BP. The fourth angle, $\theta_4$, may be, for example, 25°.

In general, protrusions 44 and rounded ribs 48 are provided to strengthen the sidewalls 14,16,18,20 against lateral forces.

The packaging container 10, finally, may have a flange 56 integrally formed with the top edge 38 of the sidewalls 14,16,18,20. As may be seen most clearly in FIGS. 2 and 3, the flange 56 has an upper surface with an inner portion 58 and an outer portion 60, the latter being inclined downwardly toward the bottom plane BP at a fifth angle, $\theta_5$, which may be 20°. The inner portion may be oriented parallel to the bottom plane BP.

The flange 56 also has an edge surface 62 and a lower surface 64, the edge surface 62 being oriented in a direction perpendicular to the base plane BP and the lower surface 64 being oriented parallel to the base plane BP. As stated above, the flange 56 enables plastic film used to wrap the packaging container 10 after it has been filled to grab the top edge 38 more effectively, and reduces the occurrence of tearing of the plastic film.

The outer surface 40 of the sidewalls 14,16,18,20 may be provided with a bead 66 extending thereon around the packaging container 10 below the flange 56 to further strengthen its top edge 38.

Figure 5:
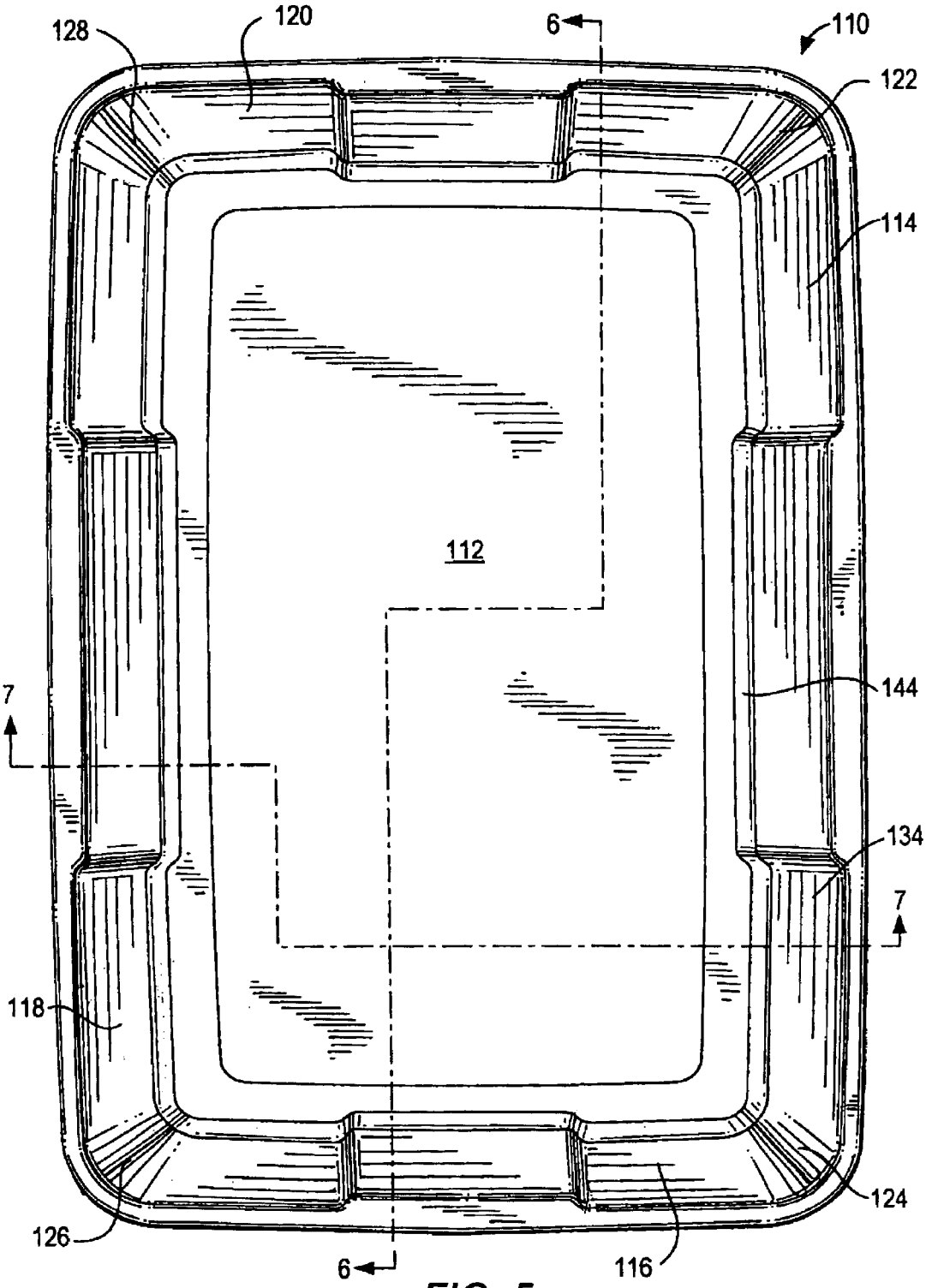
FIG. 5 is a top plan view of a second embodiment of the packaging container of the present invention.
Figure 6:
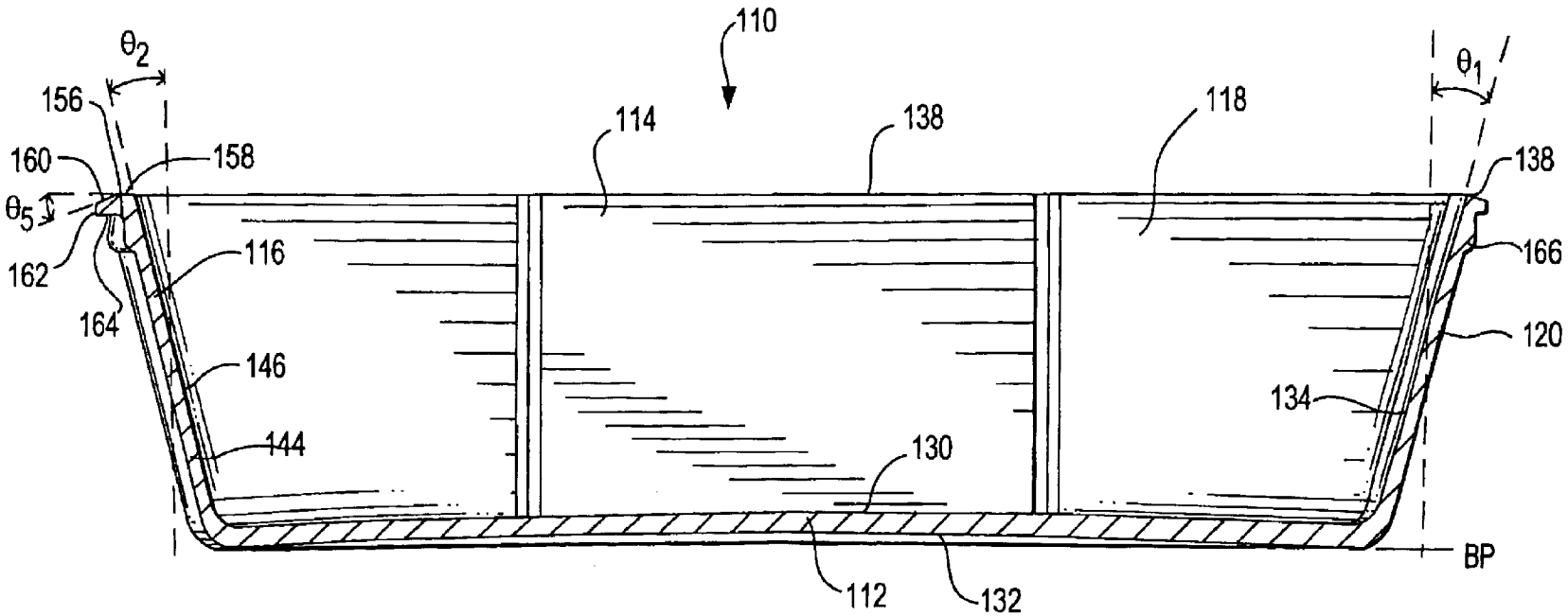
FIG. 6 is a cross-sectional view taken as indicated by line 6–6' in FIG. 5.
Figure 7:
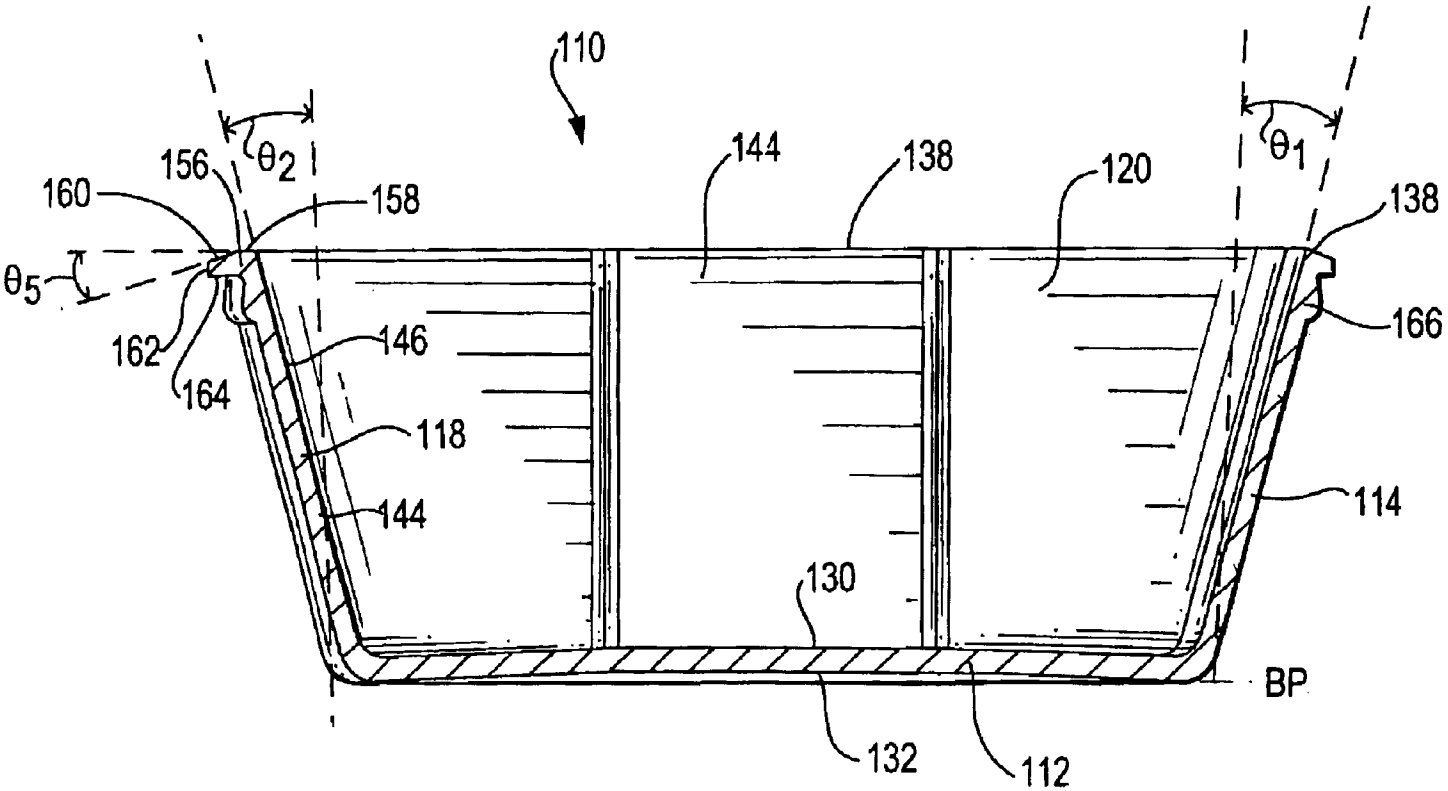
FIG. 7 is a cross-sectional view taken as indicated by line 7–7' in FIG. 5.
Figure 8:
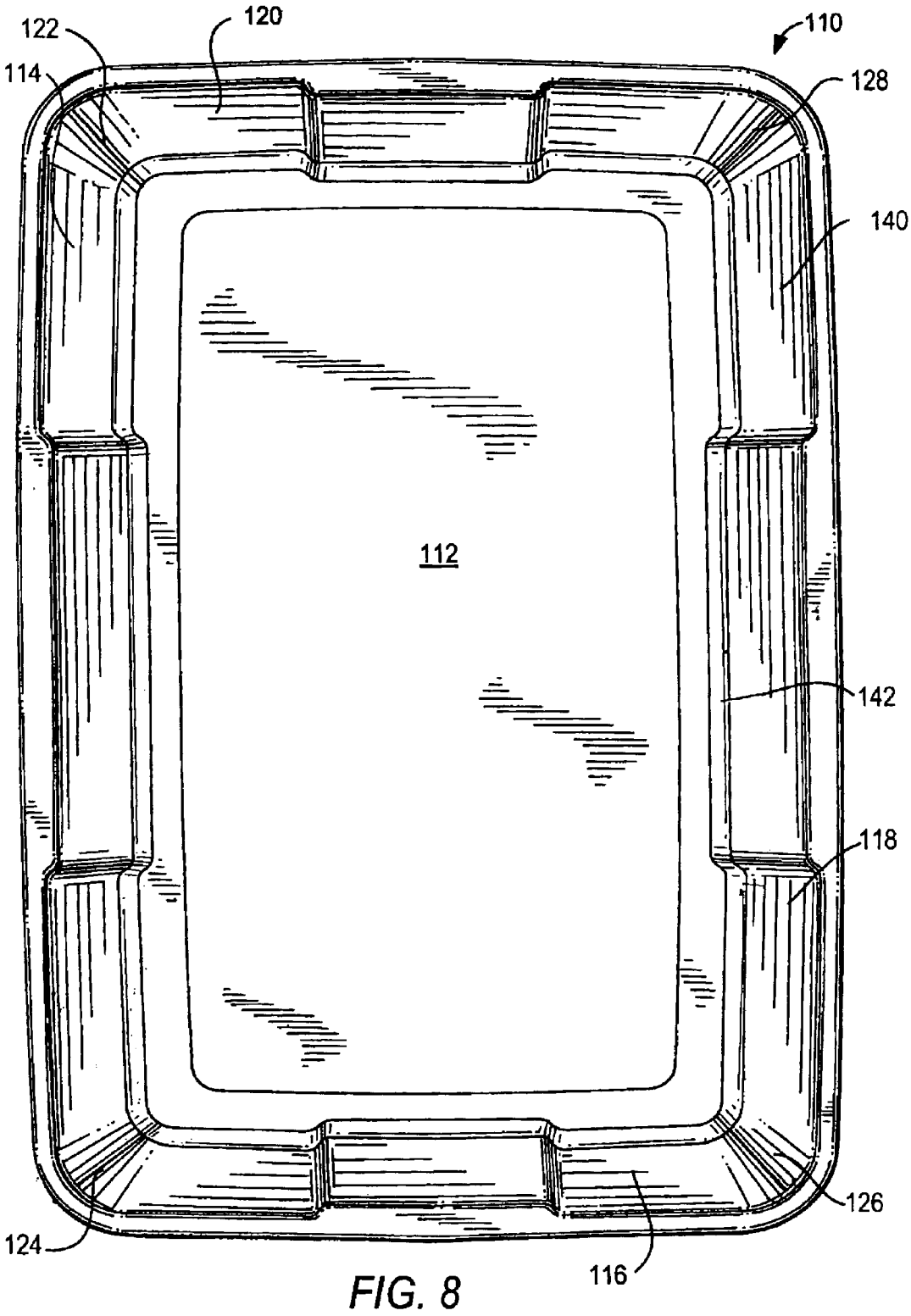
FIG. 8 is a bottom plan view of the second embodiment.

A second embodiment of the present packaging container is shown in FIGS. 5 through 8. FIGS. 5 and 8 are top and bottom plan views, respectively. FIG. 6 is a cross-sectional view taken as indicated by line 6–6' in FIG. 5; FIG. 7 is a cross-sectional view taken as indicated by line 7–7' in FIG. 5.

It will be observed that this second embodiment of the packaging container of the present invention differs from that described above in two principal respects: it lacks the pair of rounded ribs on two mutually facing sidewalls, and its sidewalls do not flare outwardly at a point approximately halfway between the base and the top edge. It should be understood, however, that this second embodiment could be provided with either one of these features without departing from the scope of the present invention.

Packaging container 110, as shown in FIGS. 5 through 8, includes a base 112, four sidewalls 114,116,118,120, and four corners 122,124,126,128 integrally formed from a plastic foam material, specifically, extruded polystyrene foam.

Base 112, as may be more readily seen in FIGS. 6 and 7, has a top surface 130 and a bottom surface 132. As above, the top surface 130 is literally the bottom of the interior of the packaging container 110, while the bottom surface 132 is the underside of the exterior of the packaging container 110. The bottom surface 132 defines a bottom plane BP which coextends with a planar surface on which the packaging container 110 may be placed. As shown in FIGS. 6 and 7, the base 112, and particularly its bottom surface 132, may be concave, as indicated by its upward bulge relative to bottom plane BP, to strengthen it and to accommodate plastic film as previously explained.

The sidewalls 114,116,118,120 each have an inner surface, an outer surface and a top edge extending therebetween. Referring particularly to FIGS. 6 and 7, and to the cross sections through sidewall 120 and sidewall 114 shown respectively therein, the sidewalls 114,116,118,120 have an inner surface 134 which is oriented at a first angle, $\theta_1$, relative to a reference direction perpendicular to the bottom plane BP. The first angle, $\theta_1$, may be, for example 15°.

Each of the four sidewalls 114,116,118,120 has a substantially rectangular indentation 142 on its outer surface 140, as shown most clearly in the bottom plan view of the packaging container 110 given in FIG. 8. The substantially rectangular indentations 142 extend as substantially rectangular protrusions 144 on the inner surface 134 of each sidewall 114, 116,118,120. The protrusions 144 have a surface 146, as shown in FIGS. 6 and 7, which is oriented at a second angle, $\theta_2$, relative to a reference direction perpendicular to the bottom plane BP. The second angle, $\theta_2$, may be 15°, that is, the same as the first angle, $\theta_1$. Protrusions 144 strengthen the sidewalls 114,116,118,120 against lateral forces.

The packaging container 110 may also have a flange 156 integrally formed with the top edge 138 of the sidewalls 114,116,18,120. As may be seen most clearly in FIGS. 6 and 7, the flange 156 has an upper surface with an inner portion 158 and an outer portion 160, the latter being inclined downwardly toward the bottom plane BP at a fifth angle, $\theta_5$, which may be 20°. The inner portion 158 may be oriented parallel to the bottom plane BP.

The flange 156 also has an edge surface 162 and a lower surface 164, the edge surface 162 being oriented in a direction perpendicular to the base plane BP and the lower surface 164 being oriented parallel to the base plane BP. As previously noted, the flange 156 enables plastic film used to wrap the packaging container 110 after it has been filled to grab the top edge 138 more effectively, and reduces the occurrence of tearing of the plastic film.

The outer surface 140 of the sidewalls 114,116,118,120 may be provided with a bead 166 extending thereon around the packaging container 110 below the flange 156 to further strengthen its top edge 138.

Modifications to the above would be obvious to those of ordinary skill in the art, but would not bring the packaging container so modified beyond the scope of the appended claims.

What is claimed is:

1. A packaging container for packaging goods, such as small fruits, vegetables and mushrooms, said packaging container being integrally formed from a plastic foam material and comprising:

a base, said base having a top surface and a bottom surface, said bottom surface defining a bottom plane;

four sidewalls integrally formed with and extending from said base, each said sidewall having an inner surface, an outer surface and a top edge extending therebetween, said inner surface of each said sidewall being oriented at a first oblique angle relative to a reference direction perpendicular to said bottom plane, said outer surface of each said sidewall having only one substantially rectangular indentation extending as a protrusion on said inner surface thereof, each said protrusion having a planar surface oriented at a second oblique angle relative to said reference direction perpendicular to said bottom plane;

a plurality of corners, each said corner being integrally formed with and extending between a pair of said sidewalls, each said corner further being integrally formed with and extending from said base; and a flange integrally formed with said top edge of said sidewalls and extending outwardly and downwardly therefrom, said flange having an upper surface with an inner portion and an outer portion, said outer portion being inclined downwardly toward said bottom plane at a flange oblique angle, and an edge surface and a lower surface.

2. A packaging container as claimed in claim 1, wherein said bottom surface of said base is concave.

3. A packaging container as claimed in claim 1, wherein said plastic foam material is of extruded polystyrene.

4. A packaging container as claimed in claim 1 wherein said first oblique angle is equal to said second oblique angle.

5. A packaging container as claimed in claim 4 wherein each said protrusion extends on said inner surface of its respective sidewall from said base to said top edge.

6. A packaging container as claimed in claim 1 wherein said first oblique angle is less than said second oblique angle.

7. A packaging container as claimed in claim 6 wherein each said sidewall flares outward substantially halfway between said base and said top edge at a third oblique angle relative to said reference direction perpendicular to said bottom plane.

8. A packaging container as claimed in claim 7 wherein said third oblique angle is equal to said second oblique angle.

9. A packaging container as claimed in claim 7 wherein each said protrusion extends on said inner surface of its respective sidewall from said base to said top edge.

10. A packaging container as claimed in claim 1 further comprising at least one rounded rib protruding from said inner surface of at least one of said sidewalls adjacent to said protrusion, said rounded rib being a rounded indentation on said outer surface of said sidewall, said rounded rib having a surface oriented at a fourth oblique angle relative to said reference direction perpendicular to said bottom plane.

11. A packaging container as claimed in claim 10 wherein said fourth oblique angle is greater than said first oblique angle.

12. A packaging container as claimed in claim 10 wherein said at least one rounded rib is a pair of rounded ribs, one rounded rib being on each side of said protrusion.

13. A packaging container as claimed in claim 10 wherein said at least one of said sidewalls is a pair of mutually facing sidewalls.

14. A packaging container as claimed in claim 13 wherein each of said pair of mutually facing sidewalls has a pair of rounded ribs, one rounded rib being on each side of said protrusions.

15. A packaging container as claimed in claim 13 wherein said pair of mutually facing sidewalls are the longer ones of said plurality of sidewalls.

16. A packaging container as claimed in claim 10 wherein said at least one rounded rib extends on said inner surface of said at least one of said sidewalls from said base to a point substantially halfway between said base and said top edge.

17. A packaging container as claimed in claim 1 wherein said inner portion of said upper surface is parallel to said bottom plane.

18. A packaging container as claimed in claim 1 wherein said flange oblique angle is 20°.

19. A packaging container as claimed in claim 1 wherein said edge portion is perpendicular to said bottom plane.

20. A packaging container as claimed in claim 1 wherein said lower portion is parallel to said bottom plane.

21. A packaging container as claimed in claim 1 further comprising a bead integrally formed with said outer surface of said sidewalls below said flange.

22. A packaging container as claimed in claim 4 wherein said first oblique angle and said second oblique angle are each 15°.

23. A packaging container as claimed in claim 6 wherein said first oblique angle is 10° and said second oblique angle is 15°.

24. A packaging container as claimed in claim 8 wherein said third oblique angle is 15°.

25. A packaging container as claimed in claim 11 wherein said fourth oblique angle is 25°.

* * * * *